US011056822B2

(12) United States Patent
Wang et al.

(10) Patent No.: US 11,056,822 B2
(45) Date of Patent: Jul. 6, 2021

(54) POWER SOCKET MODULE AND PLUG

(71) Applicant: International Business Machines Corporation, Armonk, NY (US)

(72) Inventors: Jian Wang, Beijing (CN); Jing Li, Beijing (CN); Jian Min Jiang, Beijing (CN); Ke Wang, Beijing (CN); Zi Ming Huang, Beijing (CN)

(73) Assignee: International Business Machines Corporation, Armonk, NY (US)

( * ) Notice: Subject to any disclaimer, the term of this patent is extended or adjusted under 35 U.S.C. 154(b) by 2 days.

(21) Appl. No.: 16/519,805

(22) Filed: Jul. 23, 2019

(65) Prior Publication Data

US 2021/0028574 A1 Jan. 28, 2021

(51) Int. Cl.
*H01R 13/514* (2006.01)
*H01R 13/11* (2006.01)
*H01R 13/04* (2006.01)

(52) U.S. Cl.
CPC ..... *H01R 13/514* (2013.01); *H01R 13/04* (2013.01); *H01R 13/111* (2013.01)

(58) Field of Classification Search
CPC ... F21V 21/002; H01R 13/514; H01R 13/111; H01R 13/04
USPC ..... 439/426, 886, 103, 106; 362/253
See application file for complete search history.

(56) References Cited

U.S. PATENT DOCUMENTS 4,920,467 A * 4/1990 Honsberger ..... H01R 4/2406 362/658
5,010,463 A * 4/1991 Ross ..... F21V 19/0025 362/234
5,980,326 A * 11/1999 Weidner ..... H01R 24/542 439/426
6,132,859 A * 10/2000 Jolly ..... H02G 5/005 428/319.3
6,364,692 B1 * 4/2002 Okayasu ..... H01R 13/5219 439/204
6,657,381 B1 * 12/2003 Arutaki ..... H01R 4/2406 313/512
7,665,883 B2 * 2/2010 Matheson ..... F21V 23/06 362/652
8,187,022 B2 * 5/2012 Li ..... H01R 25/145 439/426
8,390,184 B2 * 3/2013 Pet ..... F21V 21/35 313/317
8,525,402 B2 * 9/2013 Aeling ..... H05K 1/11 313/498
8,622,761 B2 1/2014 Le Page
9,373,921 B1 6/2016 Lin
9,673,576 B2 * 6/2017 Ariani ..... H01R 13/74
10,168,037 B1 * 1/2019 Neuman ..... F21K 9/90
10,680,383 B2 * 6/2020 Rudisill ..... H01R 13/6205
(Continued)

*Primary Examiner* — Abdullah A Riyami
*Assistant Examiner* — Marcus E Harcum
(74) *Attorney, Agent, or Firm* — Patterson + Sheridan, LLP

(57) ABSTRACT

A method and apparatus for providing power includes a power socket module having a first conducting layer and a second conducting layer. An insulating layer may be positioned in between the first and second conducting layers. A plug includes a first prong having a first length and second prong having a second length, where the first length is longer than the second length. When the plug is plugged into the power socket module, the first prong electrically couples to the second conducting layer, and the second prong electrically couples to the first conducting layer.

20 Claims, 5 Drawing Sheets

(56) References Cited

U.S. PATENT DOCUMENTS

2009/0291587 A1* 11/2009 Sato ..... H01R 12/675
439/426
2011/0171851 A1* 7/2011 Kishibata ..... H01R 12/592
439/426

* cited by examiner

POWER SOCKET MODULE AND PLUG

BACKGROUND

The present invention relates to alternating current (AC) and direction current (DC) electrical circuits, and more specifically, to power plugs and sockets.

Power plugs and sockets connect electric equipment to a power supply in buildings and at other sites. Business offices and commercial premises, in particular, often require a large number of power sockets at various locations along office walls to power computers, photocopiers, lighting, phone chargers, and other equipment. Even with a tangle of extension cords and power strips, a room may not have enough sockets to accommodate the number of appliances. Access to other sockets may be obstructed. For instance, office furniture and architectural room features (e.g., support columns, desks, and cabinets) may limit socket availability. Other accessibility problems can arise when an office is remodeled, and furniture and appliances are relocated.

SUMMARY

According to one embodiment of the present invention, a method includes providing a socket module including a first conducting layer and a second conducting layer. An insulating layer may be positioned in between the first and second conducting layers. The method may also include providing a plug that includes a first prong having a first length and second prong having a second length, where the first length is longer than the second length. When the plug is plugged into the socket module, the first prong electrically couples to the second conducting layer, and the second prong electrically couples to the first conducting layer.

According to another embodiment, an apparatus includes a socket module including a first conducting layer and a second conducting layer. The apparatus further includes an insulating layer positioned in between the first and second conducting layers. A plug includes a first prong having a first length and second prong having a second length, where the first length is longer than the second length. When the plug is plugged into the socket module, the first prong electrically couples to the second conducting layer, and the second prong electrically couples to the first conducting layer.

According to another particular embodiment, an apparatus includes a first insulating layer and a first conducting layer positioned below the first insulating layer. A second insulating layer may be positioned below the first conducting layer, and a second conducting layer may be positioned below the first insulating layer. A third insulating layer may be positioned below the second conducting layer. At least the first and second conducting layers, and the first and second insulating layers may be penetrable by prongs of a plug.

DETAILED DESCRIPTION

An embodiment of a power outlet system includes a plug having pins of different lengths and a multilayered power socket module. The power socket module may include a substantially planar board having five layers. For instance, a first, a third, and a fifth layer of the power socket module, may include insulation material. A second and a fourth layer of the power socket module may include conductive material. The conductive material of the layers may be connected to either a positive or a negative pole.

The plug of an embodiment may include two pins of differing lengths. When being plugged into the power socket module, a longer pin of the plug may pierce (e.g., break or puncture) to a lower conducting layer (e.g., the fourth layer) of the power socket module. The piercing may function to couple the longer pin to the further layer. A shorter pin may connect to an upper layer (e.g., the second layer) of the power socket module. In this manner, the plug and power socket modules are electrically connected.

According to an embodiment, one or more power socket areas of a power socket module each have pin-to-conductor-conduction. The system may electrically link the conductive layers of the power socket module to pins of the electrical plug when inserted into the power socket area. The power socket areas may be selectively positioned at any and all locations along the power socket module. That is, when the pins of the electrical plug are inserted into the power socket module, an electrical connection may be made between the pins and the power source through the pin-to-conductor-conduction-mechanism and the elongated-electrical-conductor.

In certain embodiments, power socket modules may be cut to fit any shape and size. The power socket modules may further be connected to one another as needed to provide more plug-in area and connectivity. To this end, power socket modules may include power connectors to attach to one another, as well as hinges or other fasteners to provide a structural connection between power socket modules. A power socket module may be flexible. For instance, one or more power socket modules may wrap around a rounded column.

In one embodiment, the pins of the plug may penetrate, or plug into, the power socket module anywhere along a surface of the power socket module. Additionally, users may plug any number of appliance plugs into the power socket module. Moreover, users do not have to align plugs according to an orientation or plug design of conventional sockets. In some embodiments, power socket modules may be repositioned to accommodate the rearrangement of desks, computers and other office equipment according to a new office layout without requiring significant rewiring.

Figure 1:
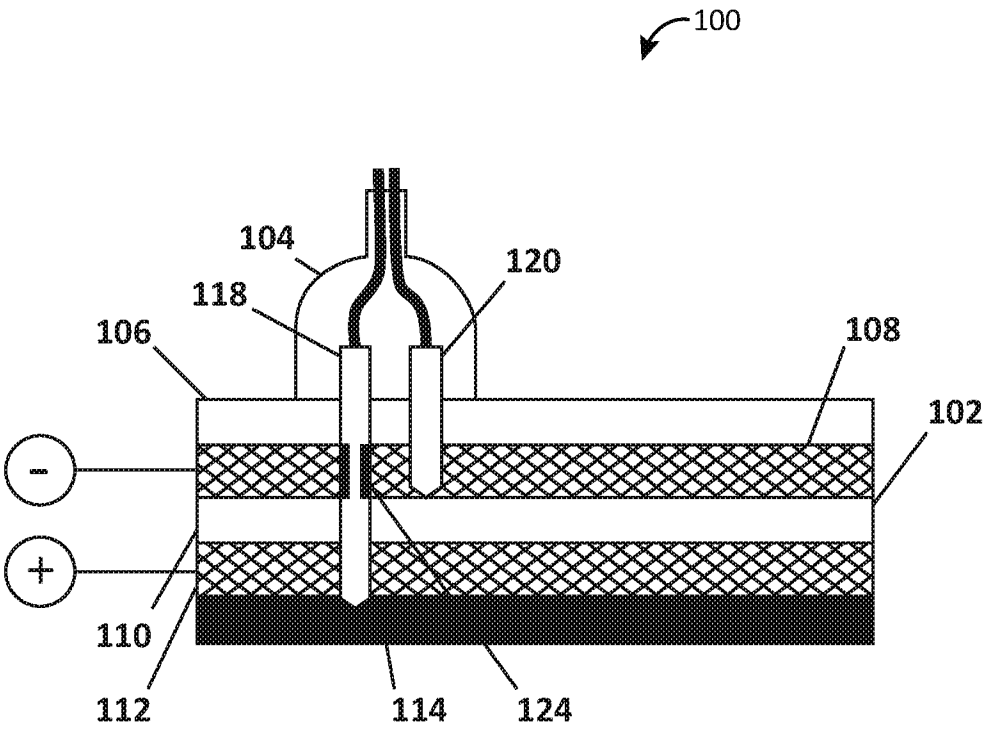
FIG. 1 shows a plug and socket electrical system that includes a layered socket module and a plug having prongs of different lengths.

Turning particularly to the Drawings, FIG. 1 shows a plug and socket electrical system 100 according to an embodiment. The system 100 may include a layered power socket module 102 and a plug 104. The power socket module 102 may include multiple layers 106, 108, 110, 112, 114. The power socket module 102 may be receive power from a power source (not shown). A first layer 106 of the power socket module 102 may include insulation material that may be pierced by prongs 118, 120 of the plug 104.

A second layer 108 of the power socket module 102 may include conductive material, such as conductive grid material. The second layer 108 may be electrically charged by a power source (not shown). As shown in FIG. 1, the second layer 108 is negatively charged. Other illustrative conductive materials may include metals, such as a mesh of gold, silver, or copper. The second layer 108 may also be configured to be pierced by prongs 118, 120 of the plug 104. The second layer 108, like the first layer 106, may be resilient and reform to substantially its original shape after being pierced by the prongs 118, 120 of the plug 104. As shown in FIG. 1, the second layer 108 is positioned on a side of the first layer 106 that is opposite a second side of the first layer 106 into which the plug 104 is connected.

A third layer 110 may include insulation material that may be pierced by the prongs 118, 120 of the plug 104. Illustrative insulation material may include rubber, plastic, cotton, foam, fiberglass, and paper, among other known electrically insulating materials. The third layer 110 may be resilient and reform to substantially its original shape after being pierced by the longer prong 118.

A fourth layer 112 of the power socket module 102 may include conductive material, such as conductive grid material. The fourth layer 112 may be electrically charged by a power source (not shown). As shown in FIG. 1, the fourth layer 112 is positively charged. The fourth layer 112 may also be configured to be pierced by the longer prong 118 of the plug 104. As with the other layers 106, 108, 110, the fourth layer 112 may have properties that make it resilient to punctures (e.g., piercing from the plug 104).

A fifth layer 114 may include insulation material that may or may not be configured to be penetrable. The layers 106, 108, 110, 112, 114 of the power socket module 102 may be formed or otherwise fastened to one another, for instance, using heat treatment or adhesives. As shown in FIG. 1, the fifth layer 114 is positioned on a side of the fourth layer 112 that is opposite a second side of the fourth layer 112 facing the third layer 110.

The prongs 118, 120 of the plug 104 of an embodiment of the system 100 have different lengths. The prongs 118, 120 may be made of conductive material shaped and otherwise configured to pierce at least the first two layers 106, 108 of the power socket module 102. For instance, the prong 118, 120 may include pointed or conical tips to puncture the layers 106, 108, 110, 112, 114 of the power socket module 102.

As shown in the embodiment of the system 100 of FIG. 1, the longer prong 118 pierces layers the first four layers 106, 108, 110, 112. An insulator covering 124 around a portion of the longer prong 118 may align with the conducting, second layer 110 when positioned in the layered power socket module 102. As such, the longer prong 118 may make an electrical connection with only the conducting fourth layer 112. More particularly, a length of the insulator covering 124 may be determined such that a lower end of the insulator coating 124 keeps the longer prong 118 disconnected from the second layer 108 at the time when the longer prong 118 starts to connect with fourth layer 112. Likewise, the insulator coating 124 keeps the longer prong 118 disconnected from the second layer 108 while the shorter prong 120 starts and remains in contact with the second layer 108. This feature may avoid a short circuit situation.

The shorter prong 120 of the plug 104 may pierce only the first two layers 106, 108. In this manner, the shorter prong 120 may be in electrical contact with only the second conducting layer 108 (e.g., and not the fourth conducting layer 112).

While the power socket module 102 of FIG. 1 includes five layers, another embodiment of a power socket module may include fewer or more layers. A thickness of the layers (e.g., either or both the conducting and insulating layers) may be determined as a product of one or more factors. For example, thickness may be based on the power running through the conducting layers, the conductivity of the layers [i.e., Siemens per meter (S/m)], and the exposed dimensions and conductivity of the prongs of the plug.

Figure 2:
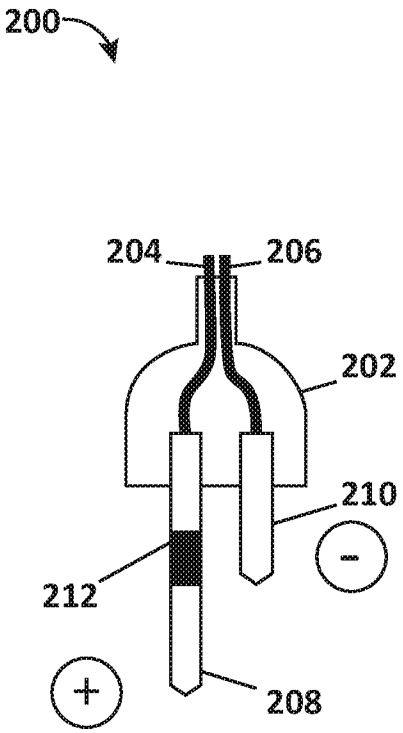
FIG. 2 shows a cross-sectional view of a plug according to an embodiment.

FIG. 2 shows a cross-sectional view of a plug 200 that is consistent with an embodiment. The plug 200 may be similar to the plug 104 of FIG. 1. The plug 200 may include a plastic or other insulating casing, housing, or enclosure 202, that houses wires 204, 206 connected to an appliance (not shown), as well as to prongs 208, 210 configured to be inserted into a layered power socket module (now shown).

As depicted in FIG. 2, a longer prong 208 of the plug 200 may be associated with a high, or positive charge, and may include an insulating coating 212. The shorter prong 210 of the plug 200 may be associated with a negative, or low charge.

Figure 3:
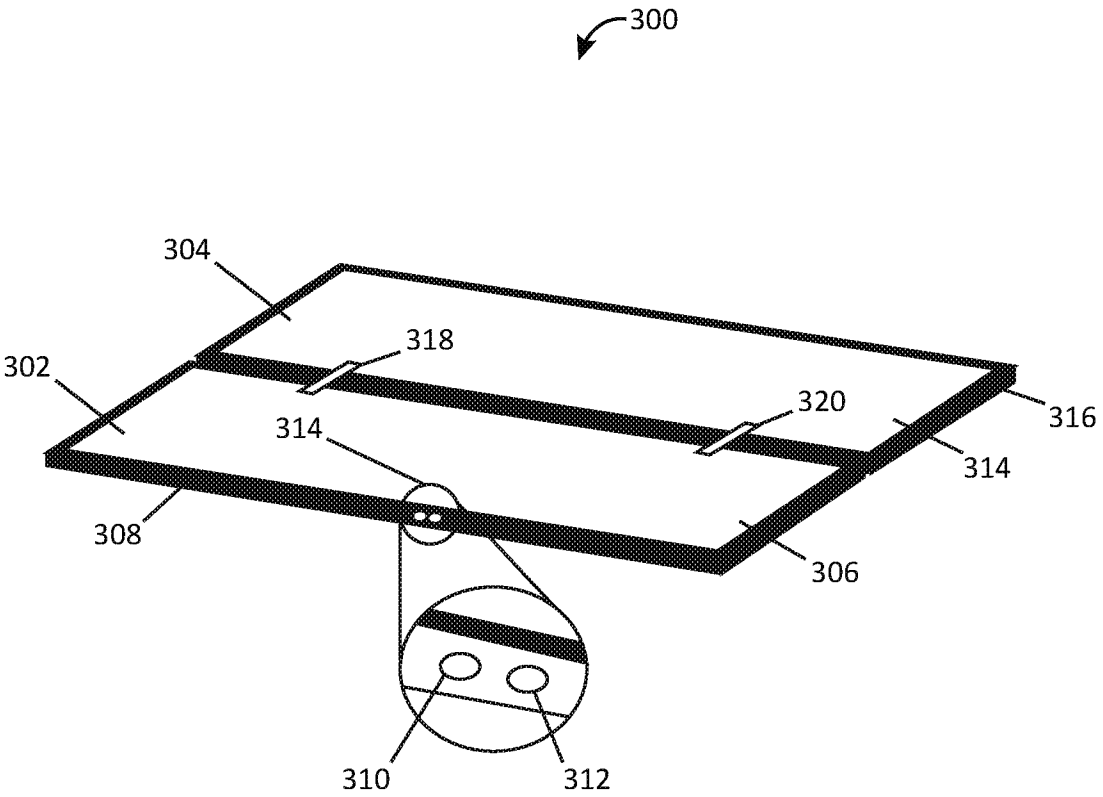
FIG. 3 is a perspective view an embodiment of a socket system that includes connected power socket modules.

FIG. 3 is a perspective view an embodiment of a socket system 300 that includes connected power socket modules 302, 304. The power socket modules 302, 304 may be similar to the power socket module 102 of FIG. 1. The first power socket module 302 may include an insulated surface 306 positioned on top of multiple conducting and insulating layers (not shown). The insulated surface 306 may provide a penetrable surface for one or more plugs to electrically connect to provide power to an appliance. In one embodiment, the insulated surface 306 may include a relatively soft material that may enable the power socket module to be crimped to fit an area where it is to be installed. The insulated surface 306 may provide a plug-in while insulating other surfaces and persons from electricity.

A frame 308 may contain the insulated surface and other layers of the first power socket module 302. The frame 308 may be constructed from rigid or semi-rigid insulating material. As shown in FIG. 3, the frame 308 of the first power socket module 302 may include a wired connection 314, such as apertures 310, 312 or other connections through which adjacent power socket modules 302, 304 may be wired or otherwise coupled.

The second power socket module 304 may be similarly or identically constructed to the first power socket module 302. As such, the second power socket module 304 may include a top insulating surface 314 and a frame 316. Flexible hinge joints 318, 320 or other fasteners (e.g., screws, adhesives, clips) may physically connect the first and second power socket modules 302, 304 to provide more plug-in area and connectivity.

While the first and second power socket modules 302, 304 in the embodiment of FIG. 3 are rectangular and planar, other power socket modules may be cut or formed to fit any shape and size. As discussed herein, a power socket module may be flexible. For instance, one or more power socket modules may wrap around a rounded column.

Figure 4:
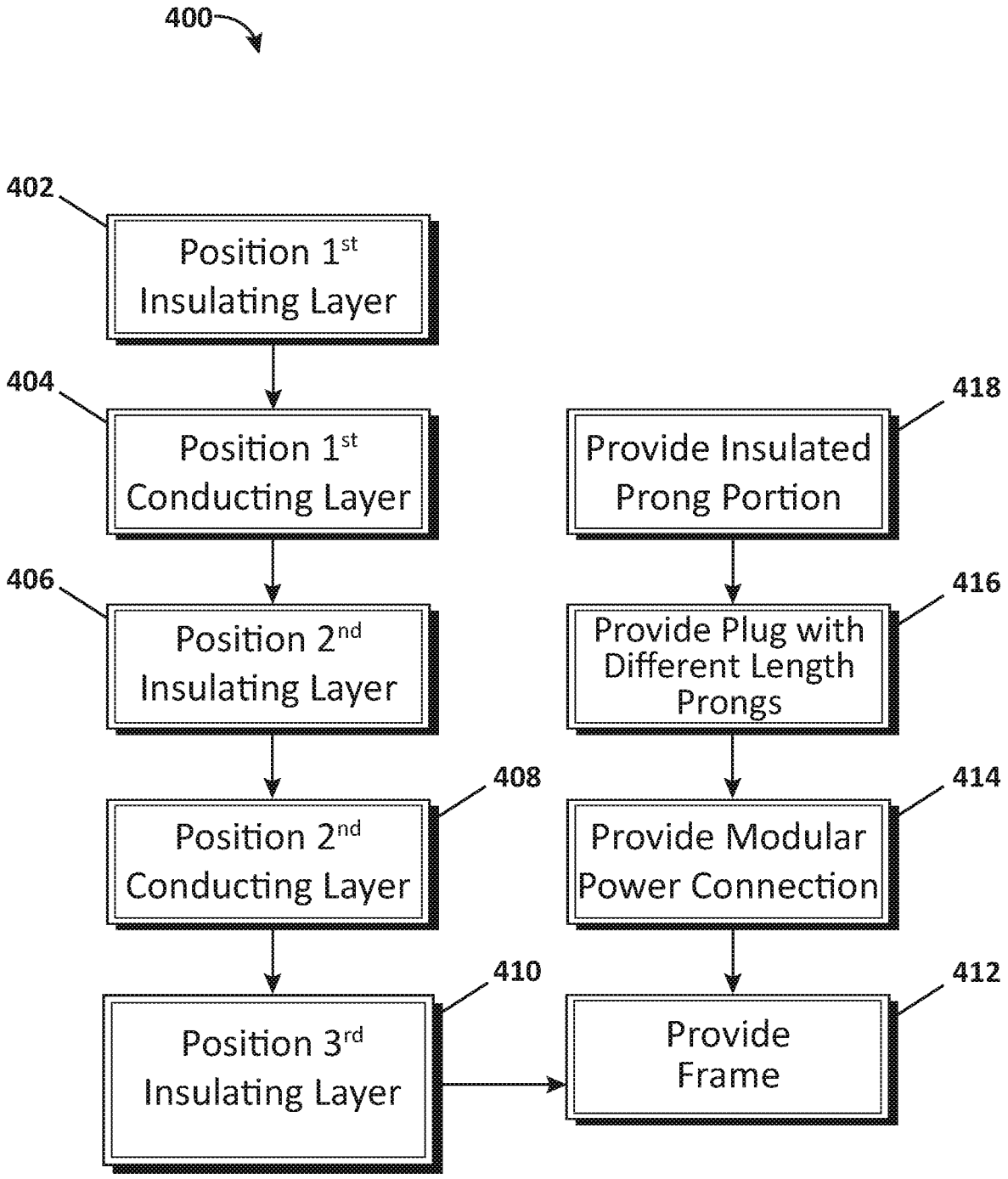
FIG. 4 is a flowchart of an embodiment of a method of manufacturing a plug and socket electrical system, such as those systems shown in FIGS. 1-3.

FIG. 4 is a flowchart of an embodiment of a method 400 of manufacturing a power socket module system, such as those systems shown in FIGS. 1-3. Turning more particularly to the blocks of the flowchart, a first insulating layer may be provided at 402. Like other layers of the power socket module described herein, the insulating layer may be flexible and resilient to piercings from plug prongs.

At 404, a first conducting layer may be positioned under the first insulating layer. The layers may be adhered or otherwise attached directly. The conducting layer may include conductive material, such as conductive grid material. The first conducting layer may be electrically charged by a power source.

A second insulating layer may be positioned under the first conducting layer at 406. Similarly, a second conducting layer may be positioned under the second insulating layer at 408. A third insulating layer may be positioned under the second conducting layer at 410, and a frame may be positioned around all of the layers at 412. A power connection and adjacent power socket module connection may be provided in the frame at 414.

A plug configured for use with the power socket module may be provided at 416. The plug may have at least two prongs, but may have more. The prongs may be different lengths. An insulating portion, such as the insulating portion 212 shown in FIG. 2, may be included on at least one of the prongs at 418.

Figure 5:
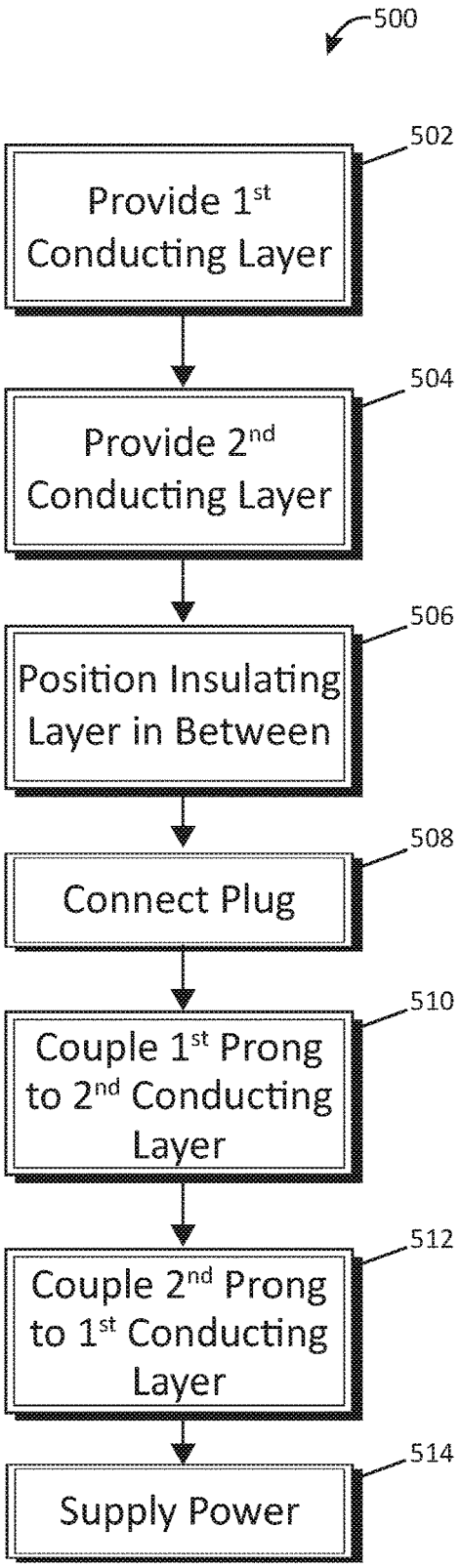
FIG. 5 is a flowchart of an embodiment of a method of implementing a power socket module system, such as those systems explained in FIGS. 1-3.

FIG. 5 is a flowchart of an embodiment of a method 500 of implementing a power socket module system, such as those described in FIGS. 1-4. Turning more particularly to the blocks of the flowchart, a first conducting layer of a power socket module may be provided at 502. At 504, a second conducting layer may be provided. An insulating layer may be positioned at 506 in between the first and second conducting layers.

At 508, a plug may be plugged into the power socket module. The plug may include a first prong having a first length and second prong having a second length. The first length may be longer than the second length. When the plug is plugged into the power socket module, the first prong may electrically couple at 510 to the second conducting layer. The second prong may at 512 electrically couple to the first conducting layer. In terms of the embodiment of the system shown in FIG. 1, the shorter prong 120 may pierce the first insulating layer 106 and the first conducting layer 108. The longer prong 118 of the plug 104 may be inserted through the first insulating layer 106, the first conducting layer 108, the second insulating layer 110, and the second conducting layer 112.

Power may be provided to an appliance at 514 from the source power socket module via the plug. Embodiments of the system may be used for both AC and direction current (DC) applications. In one embodiment, the pins of the plug may penetrate, or plug into, the power socket module anywhere along a surface of the power socket module. Additionally, users may plug any number of appliance plugs into the power socket module. Moreover, users do not have to align plugs according to an orientation or plug design of conventional sockets.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

In the following, reference is made to embodiments presented in this disclosure. However, the scope of the present disclosure is not limited to specific described embodiments. Instead, any combination of the following features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the following aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

The present invention may be a system or a method. Aspects of the present invention are described herein with reference to flowchart illustrations and/or block diagrams of methods, and apparatus (systems or circuits) according to embodiments of the invention.

The flowchart and block diagrams in the Figures illustrate the architecture, functionality, and operation of possible implementations of systems and methods according to various embodiments of the present invention. In this regard, each block in the flowchart or block diagrams may represent a module, segment, or portion of instructions, which comprises one or more instructions. In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the foregoing is directed to embodiments of the present invention, other and further embodiments of the invention may be devised without departing from the basic scope thereof, and the scope thereof is determined by the claims that follow.

What is claimed is:

1. A method of providing power, the method comprising:

providing a power socket module including:

a first conducting layer;

a second conducting layer; and a first insulating layer positioned in between the first and second conducting layers; and providing a plug that includes an enclosure, a first prong having a first length, a second prong having a second length, a first wire coupled to the first prong, and a second wire coupled to the second prong, wherein the first length is longer than the second length, wherein the enclosure houses a portion of the first prong, a portion of the second prong, a portion of the first wire, and a portion of the second wire, and wherein the first and second wires extend out of the enclosure to couple to an appliance and wherein when the plug is plugged into the power socket module, the first prong electrically couples to the second conducting layer, and the second prong electrically couples to the first conducting layer, and wherein a thickness of at least one of the first conducting layer and first insulating layer is based on at least one of:

power supplied to the first conducting layer, a conductivity of the first conducting layer, or a conductivity of either prong of the plug.

2. The method of claim 1, wherein a second insulating layer is positioned on a side of the first conducting layer that is opposite a second side of the first conducting layer facing the second conducting layer.

3. The method of claim 2, wherein a third insulating layer is positioned on a side of the second conducting layer that is opposite a second side of the second conducting layer facing the first insulating layer.

4. The method of claim 1, further comprising using the first prong to penetrate the first conducting layer, the first insulating layer, and the second conducting layer.

5. The method of claim 1, further comprising constructing at least one of the first conducting layer, the first insulating layer, and the second conducting layer from a material that is resilient to puncturing.

6. The method of claim 1, further comprising electrically coupling a second power socket module to the power socket module.

7. The method of claim 1, further comprising mechanically attaching a second power socket module to the power socket module.

8. The method of claim 1, wherein the power socket module is flexible.

9. The method of claim 1, wherein the thickness of at least one of the first conducting layer and first insulating layer is further based on an exposed dimension of either prong of the plug.

10. An apparatus, comprising:

a plug casing;

a first prong having a first length extending from the plug case in a first direction;

a second prong having a second length extending from the plug case in the first direction, wherein the first length is longer than the second length;

a first wire coupled to the first prong; and a second wire coupled to the second prong, wherein the casing houses a portion of the first prong, a portion of the second prong, a portion of the first wire, and a portion of the second wire, and wherein the first and second wires extend out of the casing to couple to an appliance, wherein when the first prong electrically couples to a first conducting layer, and the second prong electrically couples to a second conducting layer, wherein a first insulating layer is positioned between the first and second conducting layers, and wherein a thickness of at least one of the first conducting layer and first insulating layer is based on at least one of: power supplied to the first conducting layer, a conductivity of the first conducting layer, or a conductivity of either prong.

11. The apparatus of claim 10, wherein a portion of the first prong of the plug includes an insulating covering.

12. The apparatus of claim 11, wherein the insulating covering encircles the portion of the first prong.

13. The apparatus of claim 10, wherein the first prong penetrates the first conducting layer.

14. The apparatus of claim 13, wherein the first prong penetrates the second conducting layer.

15. The apparatus of claim 14, wherein the first prong penetrates an insulating layer positioned between the first and second conducting layers.

16. The apparatus of claim 10, wherein the second prong does not penetrate the second conducting layer.

17. The apparatus of claim 16, wherein the second prong penetrates the first conducting layer.

18. An apparatus comprising:

a first insulating layer;

a first conducting layer positioned below the first insulating layer;

a second insulating layer positioned below the first conducting layer;

a second conducting layer positioned below the first insulating layer; and a third insulating layer positioned below the second conducting layer, wherein at least the first and second conducting layers, and the first and second insulating layers are penetrable by prongs of a plug, the plug comprises an enclosure, a first prong having a first length, a second prong having a second length, a first wire coupled to the first prong, and a second wire coupled to the second prong, wherein the first length is longer than the second length, wherein the enclosure houses a portion of the first prong, a portion of the second prong, a portion of the first wire, and a portion of the second wire, wherein the first and second wires extend out of the enclosure to couple to an appliance, wherein the first prong electrically couples to the second conducting layer and the second prong electrically couples to the first conducting layer, and wherein a thickness of at least one of the first conducting layer and first insulating layer is based on at least one of: power supplied to the first conducting layer, a conductivity of the first conducting layer, or a conductivity of either prong of the plug.

19. The apparatus of claim 18, wherein at least one of the first conducting layer, the first insulating layer, the second conducting layer, the second insulating layer, and the third insulating layer are constructed from a material that is resilient to punctures.

20. The apparatus of claim 18, further comprising electrically coupling a power socket module to the first and second conducting layers.

* * * * *